United States Patent [19]

Stull

[11] Patent Number: 4,646,949

[45] Date of Patent: Mar. 3, 1987

[54] CAPTIVE DISPENSING CAP CONSTRUCTION

[76] Inventor: Gene Stull, 5 Oak St., Chester, N.J. 07930

[21] Appl. No.: 815,718

[22] Filed: Jan. 2, 1986

[51] Int. Cl.[4] ..... B67D 5/06

[52] U.S. Cl. ..... 222/521; 215/330

[58] Field of Search ..... 215/329, 330; 220/315; 222/153, 498, 499, 519–521, 544–545, 548–549

[56] References Cited

U.S. PATENT DOCUMENTS

| | | | |
|---|---|---|---|
| 3,406,880 | 10/1968 | Stull | 222/521 |
| 3,407,967 | 10/1968 | Stull | 222/521 X |
| 3,433,394 | 3/1969 | Stull | 222/519 |
| 3,598,285 | 8/1971 | Stull | 222/48 |
| 4,230,232 | 10/1980 | Atkins | 215/330 |
| 4,289,248 | 9/1981 | Lynn | 215/330 |
| 4,438,870 | 3/1984 | Stull | 222/48 |
| 4,461,394 | 7/1984 | Sendel et al. | 215/330 |
| 4,494,665 | 1/1985 | Lehmann | 215/330 |

*Primary Examiner*—H. Grant Skaggs
*Assistant Examiner*—Michael S. Huppert
*Attorney, Agent, or Firm*—H. Gibner Lehmann; K. Gibner Lehmann

[57] ABSTRACT

A captive dispensing cap construction having a body part that is adapted to be carried on a container neck, and a screw cap part that is captive on the body part and is turnable thereon between a retracted, fully screwed on sealing position and an extended, discharge position. Cooperable threads are provided on the parts, to enable the cap part to be moved toward its retracted sealing position. The body part has a pair of upwardly facing cam tracks that are disposed opposite one another, and which are engaged respectively by a pair of interior lugs on the underside of the cap part. During unscrewing of the latter, the lugs ride up the tracks, thereby shifting the cap part axially upward toward its discharge position. Adjacent the lower ends of the cam tracks are abutment shoulders disposed in the path of movement of the lugs, providing tactual resistance to the initial unscrewing of the cap part. The arrangement is such that any tendency for the cap part to inadvertently turn from its fully on, sealing position causes the lugs to engage the abutment shoulders, such engagement resisting further turning movement. As a consequence, there is minimized the possibility of the cap part unscrewing by itself, as might otherwise occur from vibration during passage of the cap construction through automatic capping equipment, or during shipping and handling.

10 Claims, 7 Drawing Figures

CAPTIVE DISPENSING CAP CONSTRUCTION

BACKGROUND

This invention relates generally to closure cap constructions, and more particularly to devices of this type wherein a captive closure cap part is turnably carried on a body part, and wherein the latter has an upwardly-facing cam track that is adapted to be engaged by an interior lug on the cap part in order to effect axially-outward movement of the latter as it is unscrewed.

A number of different cap constructions have been proposed and produced in the past, and have met with wide acceptance in the consumer marketplace. A typical patented construction is illustrated and described in U.S. Pat. No. 3,598,285, issued Aug. 10, 1971 to Morton B. Stull, and entitled CAPTIVE DISPENSING AND METERING CAP. This reference is believed to be the most relevant prior art of which applicant is aware.

This patented cap construction incorporates a base part and a screw cap part that is turnably carried on the base part. Both parts incorporate cooperable threads which effect axial movement of the cap part when it is turned. In addition, in order to provide a more positive advancing movement of the cap part when it is unscrewed, the body part incorporates a single cam track which is engaged by a lug disposed on the underside of the cap part. The lug is particularly shown in FIG. 6 of the patent, designated by the numeral 38. Alternate constructions are illustrated in FIGS. 8 and 9. In particular, FIG. 8 of the patent shows a cam track that has a non-uniform helical pitch, and wherein there is provided a bump or discontinuity part way up the track. As the consumer unscrews the cap part, he encounters a somewhat increased resistance to turning when the cap part arrives at the discontinuity. The purpose of incorporating this discontinuity in between the ends of the cam track was to provide to the consumer a means for accurately metering the rate of discharge of the container contents. Stated differently, the design was such that when the cap part lug arrived at the discontinuity, the discharge opening was of a pre-determined size intended to provide a calibrated, reduced flow rate compared to that which occured when the cap part was fully opened. In FIG. 9, the discontinuity takes the form of a small notch or recess part way up the track, and the objective was essentially the same, one of metering the flow rate.

Other patents involving captive screw cap constructions are U.S. Pat. Nos. 3,406,880; 3,407,967 and 3,433,394. The devices disclosed therein involve cooperable threads on a cap part and a body part in combination with single or double cam tracks disposed on the body part, and wherein concealed lugs on the underside of the cap part were intended to ride up the tracks in order to provide positive lifting force.

One of the problems which has arisen in constructions of the type noted above is that following assembly of the cap part to the body part, there is a tendency for the cap part to loosen as a result of vibration that is encountered during subsequent handling of the device. Very often such devices are assembled to containers by means of automatic capping equipment, which imparts turning movement to the base part in order to screw it onto the neck of the container. The torque applied to the base part was often transmitted to the cap part, sometimes causing inadvertent loosening or unscrewing. Under such circumstances it was necessary for assembly personnel to visually inspect the caps, and to manually close any which had inadvertently become partially open. In addition, during shipping and handling of the devices, similar problems involving loosening were sometimes encountered, resulting in loss of seal, product spillage, etc. Due to the nature of the plastic of which the parts was constituted, it was not possible to completely tighten the caps, as can usually be done with relatively stiff metal lids applied to rigid glass containers. Accordingly maintaining the twist cap in its sealed position during the filling, capping, and shipping of the dispenser in many instances presented a significant problem.

SUMMARY

The above drawbacks and disadvantages of prior dispensing closures are obviated by the present invention, which has for one object the provision of a novel and improved captive dispensing cap construction which provides an abutting-type restraint against opening, which is extremely simple in its structure, and which at the same time provides a reliable, trouble-free seal of the dispenser at all times.

A related object of the invention is to provide an improved dispensing cap construction as above set forth, wherein the parts can be readily fabricated out of plastic, in simple mold cavities.

Still another object of the invention is to provide an improved dispensing cap construction as above characterized, which lends itself to assembly by automatic capping equipment, and which resists the tendency to loosen under vibration resulting from the use of such equipment.

Yet another object of the invention is to provide an improved dispensing cap construction of the kind indicated, which maintains a reliable seal under adverse conditions experienced during shipping and handling, and yet does not present an obstacle to the consumer during his use of the dispenser.

A still further object of the invention is to provide an improved dispensing cap construction as outlined above, wherein the device is easy to use, and not subject to malfunction or breakage, thereby preserving the integrity of the contents of the container.

The above objects are accomplished by a captive dispensing cap construction comprising a tubular body part adapted to be carried by a container and having a discharge spout, and a screw cap part turnably carried by and axially movable on the body part. The cap part surrounds the discharge spout and is movable between a retracted, fully screwed on sealing position and an extended, discharge position. The cap and body parts have cooperable mutually engageable portions, comprising mating screw threads, for moving the cap part axially on the body part between the retracted and the extended positions as the cap part is turned. There are provided cooperable abutting-type detent means on the cap and body parts, rendered operative when the cap part is placed in its sealing position, to yieldably hold the cap part in such sealing position, and to release the cap part for movement in an unscrewing direction toward its discharge position in response to a predetermined turning force being applied to the cap part. The arrangement is such that with the cap part in its sealing position, the detent operates to prevent initial inadvertent unscrewing movement which might otherwise occur under conditions of vibration, such as are experienced during filling of the containers, capping operations, shipping, and various other handling procedures that are routinely undertaken. The detent is stiff enough to resist inadvertent turning of the cap past a certain point, yet sufficiently weak that it can be readily bypassed by a moderate manual force applied to the cap part by the consumer.

Other features and advantages will hereinafter appear.

In the drawings, illustrating a preferred embodiment of the invention:

FIG. 1 is a view, partly in side elevation and partly in vertical section, of the improved dispensing cap construction of the present invention, with the cap part shown in a retracted, fully screwed on sealing position.

FIG. 2 is a fragmentary view, showing the cap part having been unscrewed initially through only a fraction of a turn, and wherein an interior lug on the underside of the cap part has just come into engagement with an abutment shoulder adjacent the lowermost portion of a helical cam track disposed on the upwardly facing surface of the transverse wall of the body part. At this point, the cap part experiences a small increase in resistance in an unscrewing direction, and will not of its own volition override the shoulder and advance onto the cam track.

Figure 1:
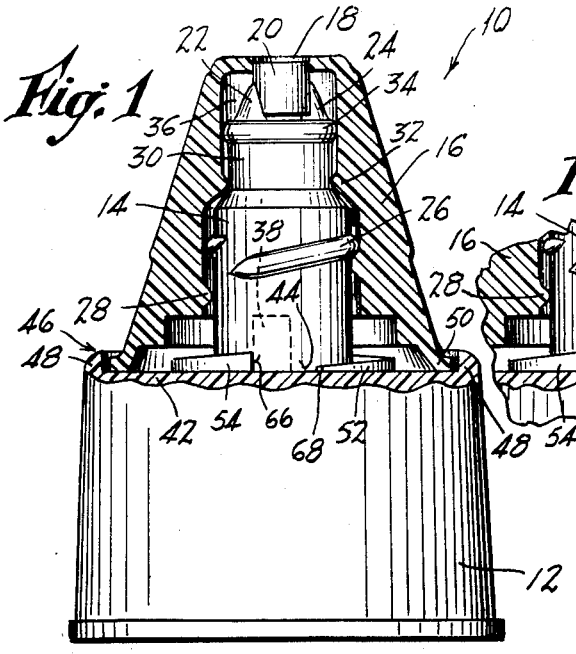
Figure 3:
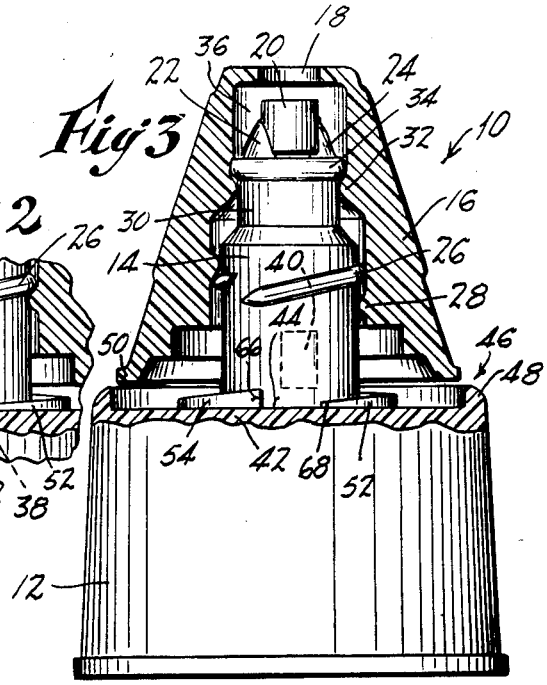
FIG. 3 is a view like that of FIG. 1, except showing the cap part as having been axially raised by a forceful manually applied unscrewing torque, to an extended, discharge position with respect to the body part.
Figure 4:
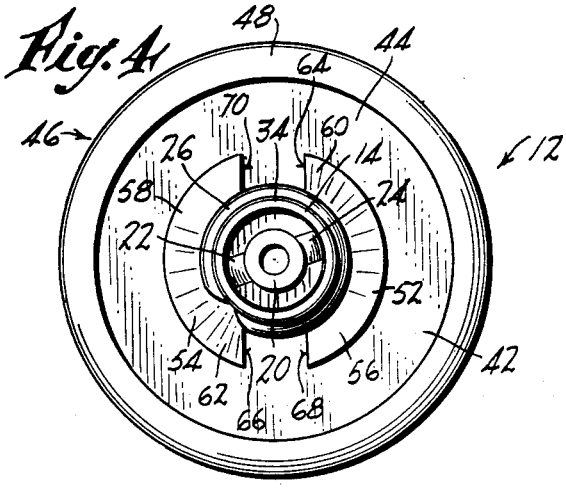
FIG. 4 is a top plan view of the body part of the construction of FIGS. 1–3.
Figure 6:
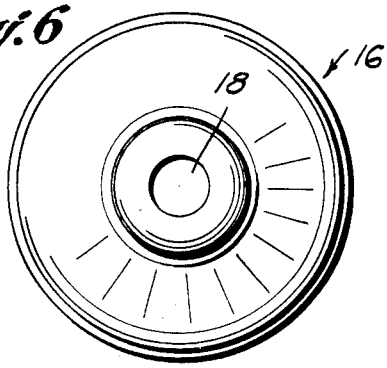
FIG. 6 is a top plan view of the cap part of the construction of FIGS. 1–3.
Figure 5:
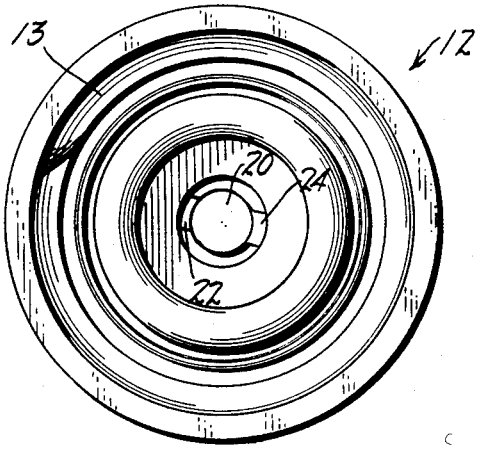
FIG. 5 is a bottom plan view of the body part shown in FIG. 4.

Referring to FIGS. 1 and 3 there is illustrated a dispensing cap construction generally designated by the numeral 10 comprising a tubular body part 12 adapted to be carried on the neck of a container (not shown), and held in position thereon by suitable internal threads 13 (FIG. 5). The body part 12 has an upstanding discharge spout 14. The cap construction 10 further includes a cap part 16 which is turnably carried by and axially movable on the body part 12. The cap part 16 surrounds the discharge spout 14 and is movable between a retracted, fully screwed on sealing position shown in FIG. 1, and an extended, discharge position illustrated in FIG. 3. The discharge spout 14 provides a passage to a discharge opening 18 in the cap part 16 when the latter is disposed in the dispensing position of FIG. 3. The spout 14 carries a cylindrical stopper peg 20 that is received in the opening 18 of the cap part 16 when it is disposed in its retracted, fully screwed on sealing position shown in FIG. 1. The stopper peg 20 is mounted to the spout 14 by means of a pair of oppositely disposed supporting webs or legs 22, 24 as shown, and is centrally disposed with respect to the axis of the spout 14.

On the exterior of the spout 14 there is provided a helical thread formation 26 that is cooperable with a second thread formation 28 on the inner surface of the cap part 16. These threads operate mostly to advance the cap part 16 from its extended or raised position of FIG. 3, toward its retracted, sealing position of FIG. 1. Disposed on the outer surface of the spout 14 is a cylindrical sealing surface 30 which is slidably engaged by an annular internal bead 32 on the cap part 16. In addition, the spout 14 has an external annular bead 34 which slides along a cylindrical inner surface 36 of the cap part 16. The beads 32, 34 are capable of engaging one another, as in FIG. 3, to retain the cap part 16 captive at all times, as can be readily understood. In addition, each bead 32, 34 forms with its cooperable cylindrical slide surface 30, 36, respectively a seal that prevents product from the area in the vicinity of the stopper peg 20 from flowing toward the threads 26, 28.

Figure 7:
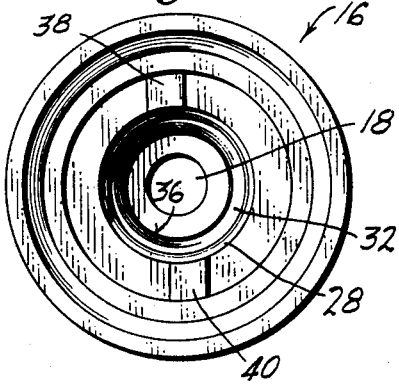
FIG. 7 is a bottom plan view of the cap part of the construction of FIGS. 1–3.

Disposed on the underside of the cap part 16 is a pair of interior lugs 38, 40, formed integrally with the part 16. The lugs 38, 40 are illustrated in dotted outline in FIGS. 1–3, and are shown in solid outline in FIG. 7. The body part 12 has a transverse top wall 42 with an upper surface 44 constituting the bottom of a cup like structure 46. The walls of the cup like structure are indicated 48, and it can be seen in FIG. 1 that the cap part 16 has a depending annular skirt 50 which is telescopically received in the cup like structure 46 with the parts 12, 16 in the relative positions of this figure. Disposed on this transverse top wall surface 44 is a pair of upstanding, upwardly facing helical cam tracks 52, 54, oppositely disposed from one another. As illustrated, the tracks 52, 54 extend circumferentially through angles of less than 180 degrees. The tracks have lowermost portions 56, 58, respectively which are disposed above the flat surface 44 of the transverse wall, and uppermost portions 60, 62. The ends of the uppermost portions 60, 62 form positive stops 64, 66 against which the lugs 38, 40, respectively are positioned when the cap part 16 is fully screwed on.

Figure 2:
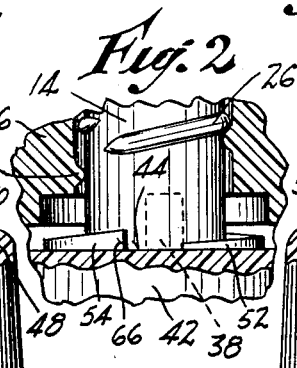

In accordance with the present invention there is provided a novel abutment-type detent means in the form of a pair of abutment shoulders 68, 70 disposed adjacent the lowermost portions 56, 58 of the cam tracks 52, 54, respectively. These abutment shoulders 68, 70 are relatively small compared to the end stops 64, 66. FIG. 2 illustrates the position of the cap part 16 with respect to the body part 12 when the cap part 16 is initially unscrewed through a small fraction of a turn, until the side of the one lug 38 engages the abutment shoulder 68. During the transition from the position of FIG. 1 to that of FIG. 2, the lug 38 traverses the space between shoulders 66 and 68. In FIG. 1, the lug 38 is shown as having a width which is less than the spacing between these shoulders 66 and 68. Because there is some intentional looseness between the threads 26, 28, substantially no axial movement of the cap part 16 will occur, and as a result, the stopper peg 20 will still occupy the orifice 18 in the cap part 16, maintaining the seal of the dispenser. That is, the dispenser is in a sealed condition whenever the lug 38 occupies the region between the stop shoulder 66 and the abutment shoulder 68.

When the consumer first uses the dispenser, the cap part 16 may occupy any rotary position between that shown in FIG. 1 and that of FIG. 2, an arc of perhaps 20 degrees or so. The existence of the abutment shoulder 68 at a location in the path of movement of the lug 38 prevents inadvertent loosening of the cap part 16 prior to the first use by the consumer. The same is true of the shoulder 70 and lug 40. When the consumer forcibly unscrews the cap part 16, the lug 38 as well as the oppositely disposed lug 40 will be forced to ride up over the corresponding abutment shoulder 68 or 70. Since these shoulders are relatively shallow, the resistance encountered in accomplishing this step is minimal, but noticeable to the consumer. Continued unscrewing movement of the cap part 16 will result in the lugs 38, 40 riding up their respective cam tracks 52, 54, as in the prior patented constructions cited above. When the lugs 38, 40 arrive at the tops of the tracks 52, 54, the cap part 16 is fully extended, and the orifice 18 is no longer blocked off by the peg 20. Continued turning of the cap part 16 in an unscrewing direction will merely cause the threads 26, 28 to strip past one another, since the interference between the annular beads 32, 34 is sufficient to hold the cap part 16 captive. Stated differently, the threads 26, 28 are so dimensioned that they will strip past one another in a non-destructive manner, and not cause a forcible by-pass of the beads 32, 34.

When it is desired to return the cap part 16 to the fully screwed on sealing position, the consumer merely turns it in a clockwise direction, and the threads 26, 28 will draw the part 16 axially downward. Continued turning will eventually bring the lugs 38, 40 into engagement with the stop shoulders 66, 64, respectively as shown in FIG. 1. The dispenser is now in its retracted, sealing position, ready for subsequent use.

The disclosed arrangement has the following important advantage, which is not found in the devices of the prior art. Once the cap part 16 is assembled to the body part 12, with the lugs 38, 40 occupying the areas between the respective cam tracks, inadvertent vibration from capping equipment, or from other machinery associated with filling the dispensing containers (not shown), or alternately from handling and shipping, will not give rise to any axial movement of the cap part 16, thereby preserving the integrity of the seal between the stopper peg 20 and the walls of the orifice 18. Such a feature is of considerable significance, since it is saving of labor and prevents both spillage of product, and possible contamination thereof from matter that is external to the container. Also, in cases where dispensers are cleaned after filling with product, and thereafter wiped dry, the tendency for the cap part 16 to be inadvertently opened is substantially completely eliminated. As a result there is no need to perform an additional inspection of the devices prior to shipment to the facilities where the products are to be sold. As noted, problems of leakage and product contamination are also virtually eliminated.

The device is thus seen to represent a distinct advance and improvement in the field of dispensing closures.

Each and every one of the appended claims defines an aspect of the invention which is separate and distinct from all others, and accordingly each claim is intended to be treated in this manner when examined in the light of the prior art devices in any determination of novelty or validity.

Variations and modifications are possible without departing from the spirit of the invention.

What is claimed is:

1. A captive dispensing cap construction comprising, in combination:

(a) a tubular body part adapted to be carried by a container and having a discharge spout, (b) a screw cap part turnably carried by and axially movable on said body part, said cap part surrounding said discharge spout and being movable between a retracted, fully screwed on sealing position and an extended, discharge position, (c) said cap and body parts having cooperable mutually engageable portions for moving the cap part axially on the body part from the said retracted to extended positions as the cap part is turned in an unscrewing direction, and (d) cooperable detent means on said cap and body parts, capable of being operative upon the cap part being placed in its sealing position on the body part, to yieldably hold the cap part in said sealing position and prior to any discharge occuring through the body part, said detent means yielding to release the cap part for movement in an unscrewing direction to its discharge position in response to a predetermined turning force being applied to the cap part, (e) said mutually engageable portions comprising an arcuate, upwardly facing cam track on said body part, and an interior lug on said cap part, adapted to engage said track and ride up the latter as the cap part moves from its retracted, fully screwed on sealing position toward its extended, discharge position, (f) said detent means comprising means defining an abutment shoulder below the lower end of the said cam track, (g) said abutment shoulder being engageable by said interior lug when the cap part is initially moved from its retracted fully screwed on sealing position, (h) said engagement resisting subsequent relative turning movement of the cap part and thereby tending to maintain the latter in the sealing position.

2. A captive cap construction as defined in claim 1, wherein:

(a) said body part has a transverse top wall defining a generally flat surface, (b) said cam track having its lower end disposed above said flat surface, (c) said lug being seated on said surface when the cap part is disposed in its retracted, fully screwed on sealing position, (d) said abutment shoulder being disposed between the lower end of the said cam track and the flat surface.

3. A captive cap construction as defined in claim 1, wherein:

(a) said body part has a transverse top wall constituting part of an upwardly facing cup containing said cam track, (b) said cap part having a depending annular skirt, said skirt being receivable in said cup and adapted to seat against the bottom wall thereof when the cap part is disposed in its retracted, fully screwed on sealing position.

4. A captive cap construction as defined in claim 1, wherein:

(a) said cap and body parts have cooperable retaining structures tending to hold the cap part captive against inadvertent removal.

5. A captive cap construction as defined in claim 4, wherein:

(a) said cooperable retaining structures comprise a pair of annular retainer beads disposed respectively on the body part and cap part.

6. A captive cap construction as defined in claim 1, wherein:

(a) said body part has a stopper peg located at the top of its discharge spout, (b) said cap part having a transverse top wall containing a discharge orifice, (c) said peg being receivable in the orifice of the cap part when the latter is disposed in its retracted fully screwed on sealing position, thereby to close off the orifice.

7. A captive cap construction as defined in claim 1, wherein:

(a) said cap part has an interior annular sealing surface, (b) said body part having a cooperable annular sealing surface adapted for sliding engagement with the sealing surface of the cap part as the latter is moved axially, (c) said sealing surfaces preventing dispensed product from flowing from the area around the spout toward the said mutually engageable portions that effect movement of the cap.

8. A captive dispensing cap construction comprising, in combination:

(a) a tubular body part adapted to be carried by a container and having a discharge spout, (b) a screw cap part turnably carried by and axially movable on said body part, said cap part surrounding said discharge spout and being movable between a retracted, fully screwed on sealing position and an extended, discharge position, (c) said cap and body parts having cooperable mutually engageable portions for moving the cap part axially on the body part from the said retracted to extended positions as the cap part is turned in an unscrewing direction; and (d) cooperable detent means on said cap and body parts, capable of being operative upon the cap part being placed in its sealing position on the body part, to yieldably hold the cap part in said sealing position and prior to any discharge occuring through the body part, said detent means yielding to release the cap part for movement in an unscrewing direction to its discharge position in response to a predetermined turning force being applied to the cap part, (e) said mutually engageable portions comprising a pair of symmetrically disposed, upwardly facing cam tracks on said body part, said cam tracks being disposed substantially diametrically opposite one another, and a pair of interior lugs on said cap part, disposed substantially diametrically opposite one another, said lugs being adapted to engage said tracks, respectively, and ride up the same as the cap part moves from its retracted, fully screwed on sealing position toward its extended, discharge position, (f) said detent means comprising means defining a pair of abutment shoulders below the lower ends of the cam tracks, respectively, (g) said abutment shoulders being engageable, respectively, by said interior lugs when the cap part is initiallly moved from its retracted fully screwed on sealing position, (h) said engagement resisting subsequent relative turning movement of the cap part and thereby tending to maintain the latter in the sealing position.

9. A captive dispensing cap construction comprising, in combination:

(a) a tubular body part adapted to be carried by a container and having a discharge spout, (b) a screw cap part turnably carried by and axially movable on said body part, said cap part surrounding said discharge spout and being movable between a retracted, fully screwed on sealing position and an extended, discharge position, (c) said cap and body parts having cooperable mutually engageable portions for moving the cap part axially on the body part from the said retracted to extended positions as the cap part is turned in an unscrewing direction, and (d) cooperable detent means on said cap and body parts, capable of being operative upon the cap part being placed in its sealing position on the body part, to yieldably hold the cap part in said sealing position and prior to any discharge occurring through the body part, said detent means yielding to release the cap part for movement in an unscrewing direction it its discharge position in response to a predetermined turning force being applied to the cap part, (e) said mutually engageable portions comprising a pair of symmetrically disposed, upwardly facing cam tracks on said body part, disposed substantially diametrically opposite one another, and a pair of interior lugs on said cap part, disposed substantially diametrically opposite one another, said lugs being adapted to engage said tracks, respectively, and ride up the same as the cap part moves from its retracted, fully screwed on sealing position toward its extended, discharge position, (f) said cam tracks extending circumferentially through angles of less than 180 degrees, (g) said detent means comprising means defining a pair of abutment shoulders below the lower ends of the cam tracks, respectively, (h) means defining a pair of shoulders at the upper ends of said cam tracks, said immediately preceding shoulders constituting stop shoulders for the interior lugs, (i) said lugs being characterized by given widths, (j) the spaces between the abutment shoulders and the adjacent stop shoulders exceeding said widths such that the cap part can be turned a limited amount between a position wherein the lugs engage the said stop shoulders, and another position wherein they engage the abutment shoulders, without undergoing any axial movement.

10. A captive dispensing cap construction comprising, in combination:

(a) a tubular body part adapted to be carried by a container and having a discharge spout, (b) a screw cap part turnably carried by and axially movable on said body part, said cap part surrounding said discharge spout and being movable between a retracted, fully screwed on sealing position and an extended, discharge position, (c) said cap and body parts having cooperable mutually engageable portions for moving the cap part axially on the body part from the said retracted to extended positions as the cap part is turned in an unscrewing direction, (d) cooperable detent means on said cap and body parts, capable of being operative upon the cap part being placed in its sealing position on the body part, to yieldably hold the cap part in said sealing position and prior to any discharge occuring through the body part, said detent means yielding to release the cap part for movement in an unscrewing direction to its discharge position in response to a predetermined turning force being applied to the cap part, (e) said mutually engageable portions comprising an arcuate, upwardly facing cam track on said body part, and an interior lug on said cap part, adapted to engage said track and ride up the latter as the cap part moves from its retracted, fully screwed on sealing position toward its extended, discharge position, (f) said cam track extending circumferentially through an angle of less than 180 degrees, (g) said detent means comprising means defining an abutment shoulder below the lower end of the cam track, and (h) means defining a shoulder at the upper end of the cam track, said immediately preceding shoulder constituting a stop shoulder for the interior lug, (i) said lug being characterized by a given width, (j) the spaces between the abutment shoulder and the stop shoulder exceeding said lug width such that the cap part can be turned a limited amount between a position wherein the lug engages the said stop shoulder, and another position wherein it engages the abutment shoulder, without undergoing substantial axial movement.

* * * * *